US006172290B1

(12) United States Patent
May

(10) Patent No.: US 6,172,290 B1
(45) Date of Patent: Jan. 9, 2001

(54) CARRIER ASSEMBLY FOR PERCUSSION INSTRUMENTS

(76) Inventor: Randall L. May, 8 Windsor, Newport Beach, CA (US) 92660

( * ) Notice: Under 35 U.S.C. 154(b), the term of this patent shall be extended for 0 days.

(21) Appl. No.: 09/507,800

(22) Filed: Feb. 22, 2000

Related U.S. Application Data

(62) Division of application No. 08/588,244, filed on Jan. 18, 1996, now Pat. No. 5,691,492, which is a division of application No. 08/976,999, filed on Nov. 24, 1997, now Pat. No. 6,028,257.

(51) Int. Cl.[7] ..... G10D 13/02
(52) U.S. Cl. ..... 84/421; 84/453
(58) Field of Search ..... 84/421, 453; D17/19; 248/298.1, 295.11, 297.21, 316.8

(56) References Cited

U.S. PATENT DOCUMENTS

D. 338,483 * 8/1993 Kurosaki ..... D17/22
3,295,811 * 1/1967 Giwosky ..... 248/229
5,487,518 * 1/1996 McCraney et al. ..... 248/225.11
5,691,492 * 11/1997 May ..... 84/421

* cited by examiner

*Primary Examiner*—Robert E. Nappi
*Assistant Examiner*—Kim Lockett
(74) *Attorney, Agent, or Firm*—Neal J. Mosely

(57) ABSTRACT

Novel hardware is disclosed for supporting drums. The hardware is of a hinged construction and has one part of the hinge connectable to an external support, e.g., J-rods on a fixed support or a marching drum carrier, and another part of the hinge connectable to the shell of a drum or to the tension rods on a drum or to other hardware on the drum. The drum hardware and drum secured thereon is preferably supported on a vest type carrier or a T-bar carrier having a plurality of separate parts removable from each other and formed of a rigid light metal such as magnesium. Aluminum or titanium. Special padding is provided on the shoulder straps, belly plate portion and other parts where cushioning is needed. One embodiment is universally adjustable. Some of the vests or T-bar carriers have cymbal-supporting hardware adjustable carried on a fluted, vertically oriented tube. Special hardware is shown for supporting cymbals.

3 Claims, 2 Drawing Sheets

CARRIER ASSEMBLY FOR PERCUSSION INSTRUMENTS

CROSS REFERENCE TO RELATED APPLICATION

This application is a division of application Ser. No. 08/588,244, now U.S. Pat. No. 5,691,492, issued Nov. 25, 1997, with continuity through intervening continuing applications, which is a division of Ser. No. 08/976,999 filed Nov. 24, 1997 now U.S. Pat. No. 6,028,257.

BACKGROUND OF THE INVENTION

1. Field of the Invention

This invention relates to new and useful improvements in apparatus for carrying percussion instruments, particularly drums of various kinds, cymbals, xylophones, and the like.

2. Brief Description of the Prior Art

The prior art discloses many examples of apparatus for supporting percussion instruments but none providing the combination of features disclosed and claimed herein.

La'Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back pressure plate and wrap about shoulders and support straps connect to the abdominal plate that has suitable fixtures for attachment of various percussion instruments.

Hsieh U.S. Pat. No. 4,799,610 shows a carrier for percussion instruments having a "T" bar, a pair of shoulder bars, a belly plate. The shoulder bars are bolted on a lateral plate of the "T" bar. The lateral plate has arc-like slots and spaced semi-circular holes permit bolts to slide in the slots. The fastening end of each shoulder bar has a hole and an arc-like slot from the upper portion to the lower portion permitting angular adjustment of the shoulder rightward or leftward for various applications. The carrier holder is applied to carrying a bass drum fastened by J-bars.

La Flame U.S. Pat. No. 4,643,032 shows a carrier for various instruments such as marching bells, a marching xylophone or a marching marimba, which are sup-ported on the apparatus by the use of suitably-constructed extension arms. The carrier frame is a U-shaped bent bar welded or otherwise attached to a belly plate and has extension arms that project from the belly plate to engage and support the instrument.

La Flame U.S. Pat. No. 4,605,144 shows an instrument carrier with a forwardly-projecting frame portion having a drum mounting assembly. The mounting assembly has adjustable clamp jaw elements with curved surfaces that conform to the cylindrical side wall of a drum. In practice, the side wall of the drum is sandwiched between the jaw elements and the assembly is secured in clamping engagement on the drum side wall by mechanical fasteners such as a pair of screw and nut sets which are passed through bores in the clamp elements and drawn tight to securely clamp the drum side wall. The mounting assembly may be mounted on the side wall of drum between the drumheads or, alternatively, on a portion of the side wall or a rim which projects outwardly of the drum head.

Dranchak U.S. Pat. No. 4,387,839 discloses a drum-supporting harness having two shoulder hooks with cushion pads or liners, a breast plate secured to the hooks, and a hanger structure attached to the breast plate and depending therefrom. Carried by the lower portion of the hanger structure are upwardly facing hooks, a spacer bar extending downward from the hooks, and a spacing abutment carried by the spacer bar and extending forwardly therefrom. The hooks and the spacing abutment engage upper and lower portions of the body of the drum. The hanger structure is adjustable or extensible by means of overlapping strips that can be secured in a number of different positions. An adapter assembly attaches to the upper rim portion of the drum for connecting of hooks 16 to the drum.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person, a rigid band with a generally bent contour to extend along a portion of the waistline area of the person to the back of the person, a back-plate riser arm supported by the ban to extend in a generally upward direction such that a portion of the arm will extend along the back thoracic region of the person, and means carried by the arm for imparting to the thoracic back region of the person a reactive force to the overhung weight of the instrument about the aforesaid means forming a fulcrum area of contact with the person.

Other possibly relevant prior art is Pyle U.S. Pat. No. 5,054,357; May U.S. Pat. No. 5,072,910 and May U.S. Pat. No. 5,300,810.

SUMMARY OF THE INVENTION

One of the objects of this invention is to provide a new and improved carrier for percussion instruments, e.g., a snare drum, having hardware for supporting a drums which connects to the tension rods on the drum and does not touch the shell of the drum.

Another object of the invention is to provide a new and improved carrier for percussion instruments, e.g., a snare drum, having hardware for supporting a drum comprising a plate with bosses having holes to receive J-rods.

Another object of the invention is to provide a new and improved carrier for percussion instruments comprising a novel T-bar carrier with belly plate, shoulder straps, and back bar of light metal such as aluminum, magnesium with a fluted tube mounted on the carrier having adjustably pivoted arms for supporting cymbals or other percussion instruments in a variety of positions.

Another object of the invention is to provide a new and improved assembly of a fluted tube and adjustably pivoted arms for supporting cymbals or other percussion instruments in a variety of positions and including means for adjusting the tone of the instruments.

Other objects of the invention will become apparent throughout the specification and claims as hereinafter related.

DESCRIPTION OF THE PREFERRED EMBODIMENTS

An Embodiment for Supporting Multiple Drum Assemblies

Figure 1:
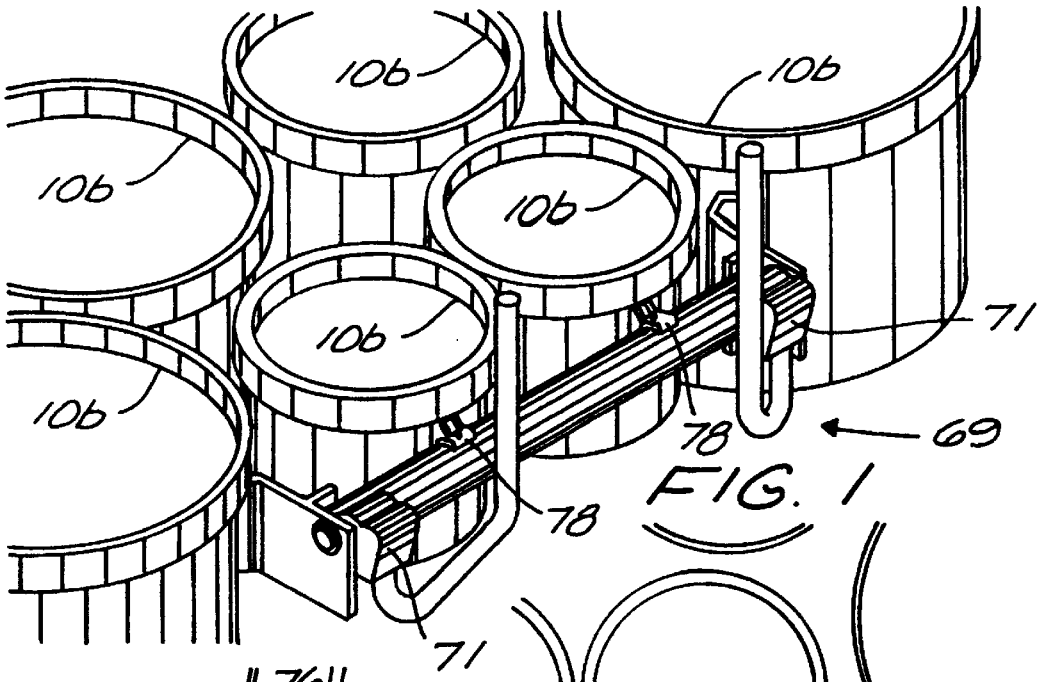
FIG. 1 is an isometric view of another embodiment of supporting hardware supporting an assembly of drums, as in a marching drum assembly.

A hardware assembly 68 (FIGS. 1–4) is provided for supporting a multiple drum assembly 69 as used in marching bands. Multiple drum assembly or array 69 (FIG. 1) comprises a plurality, typically 2–6, of drums 10*b* secured together for support and carrying by a drummer as in a marching band. In this embodiment, hardware assembly 68 provides a hinged support between the drum assembly 69 and a suitable marching carrier such the vests or T-Bar supports shown in May U.S. Pat. No. 5,691,492.

Hardware assembly 68 (FIGS. 2 & 3) comprises the combination with drum assembly 69, at the end drums 10*b*, of a supporting hinge assembly 70 having a stationary hinge portion comprising J-rod supporting members 71 and rotation hinge portion comprising end brackets 72. A cylinder 73 functions as the hinge pin for the assembly. Cylinder 73 has longitudinally extending flutes 74 in which the hooked jaws 75 of member 71 slide. T-bolt 76*a* on member 71 releasably fixes the position of member 71 longitudinally of cylinder 73. Members 71 are therefore adjustable in position according to the spacing of the J-rods on which the drum assembly is being supported and also function to vary the forward spacing of the drum assembly from the drummer.

Rotation hinge member, i.e., end brackets 72, have hooked portions 76 which may be physically attached, as by screws to the drum shells or may hook into tension rods or other abutments on the end drums 10*b* in the drum assembly. Members 77 having hooked jaws 78 slide longitudinally along flutes 74 and are fixed in position by T-bolts 79. Members 77 carry carriage bolts 80 (FIGS. 3 & 4) which penetrate the drum shell and are secured to the drum by a nut (not shown). End plates 72 are secured in position for rotation on the ends of fluted cylinder 73.

A pair of adjustable bumpers 81, for tilt adjustment, are secured through holes in a flange 82 on end plates 72 and abut fixed abutments 83 extending from fluted cylinder 73. Adjustable bumpers 82 are operated by knobs 84 on bolts extending from the bumpers to provide tilt adjustment of the drum assembly. J-rods 40 have one end extending into and supporting receptacles in members 71, and another end for support as in the various marching carriers shown and described below.

OPERATION

Figure 2:
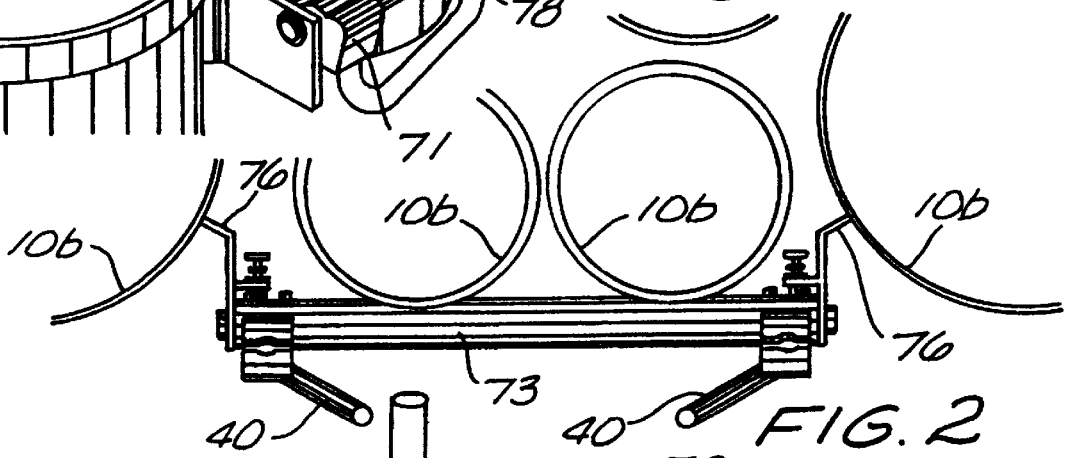
FIG. 2 is a top detail view of the hardware and a portion of the drums as shown in FIG. 1.
Figure 3:
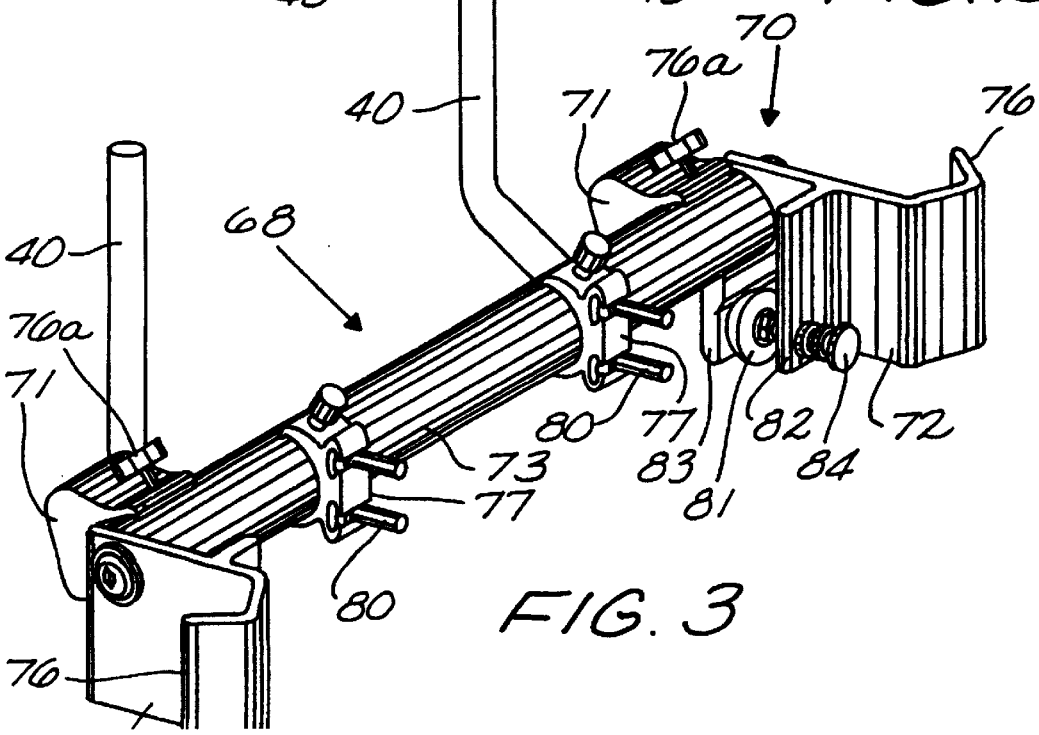
FIG. 3 is a detail isometric view of the hardware as shown in FIG. 1 showing the manner of connection of the supporting rods.
Figure 4:
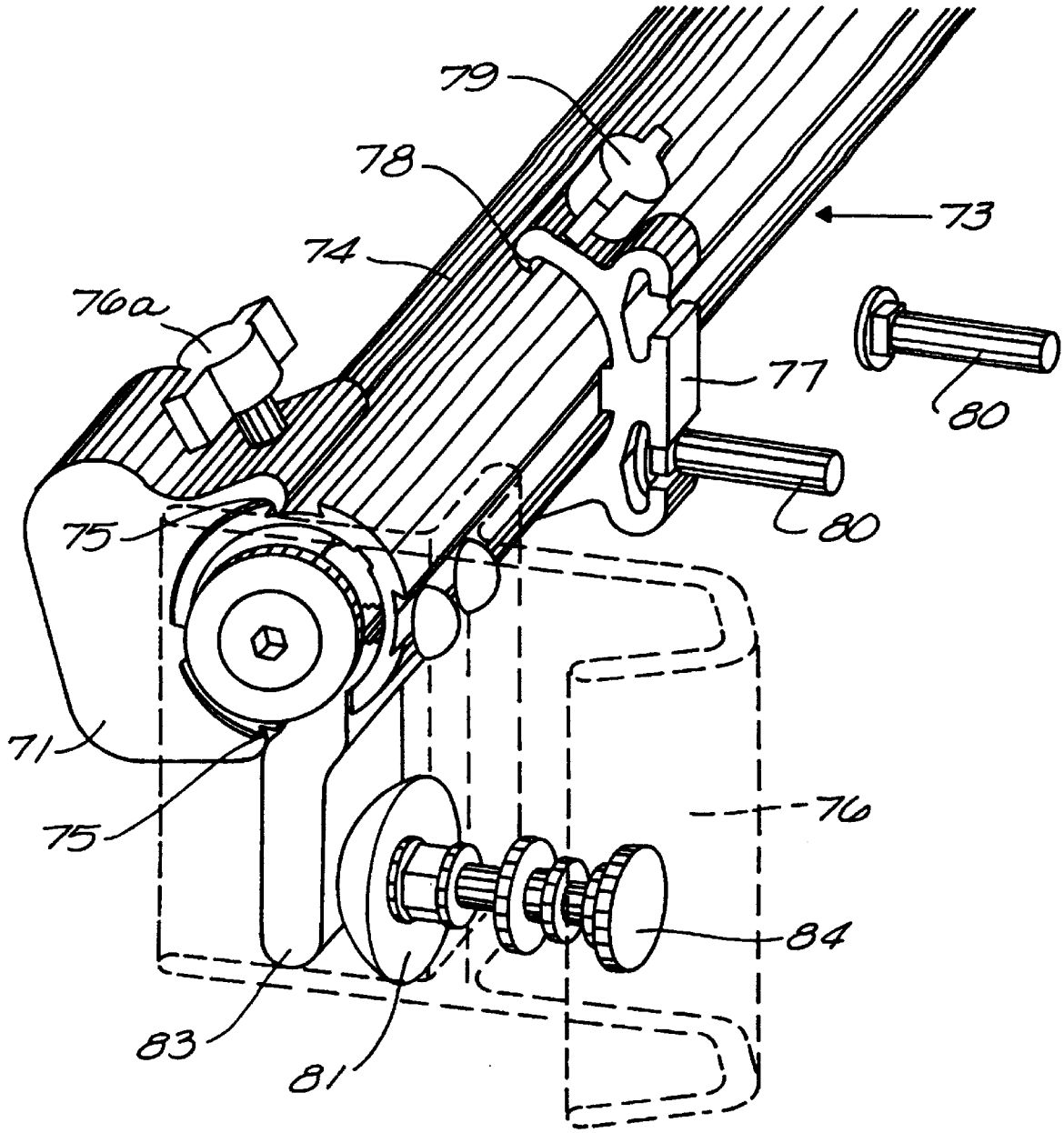
FIG. 4 is a detail isometric view of the hardware as shown in FIG. 3 showing the manner of connection of the supporting rods and the adjustable tilt feature.

The operation of this supporting hardware should be apparent but will be described in some detail for clarity of understanding. Referring to FIGS. 1–4, hardware 69 is installed on the end drums 10*b* by first securing rotation hinge members, i.e., end plates 72 against the drum assembly with hooked portions 76 secured to the drum shell by screws or hooked over two of the drum tension rods or over abutments on the end drums 10*b* of the drum assembly (FIG. 2). In this position, the drum assembly is supported on hooked portions 76 and carriage bolts 80 on members 77. Next, knob 84 is adjusted to set the amount of tilt of the drum assembly. J-rods 40 (FIGS. 1–3) are then supported in receptacles in members 71 and have their other ends supported in the supporting vests or T-bar supports or in J-rod supporting abutments in a fixed stand as described in U.S. Pat. No. 5,691,492.

While this invention has been described fully and completely, with special emphasis on several preferred embodiments and/or applications, it should be understood that within the scope of the appended claims, the invention may be practiced otherwise than as specifically described.

What is claimed is:

1. Supporting hardware, for an array of drums secured together as a group, for use with an external support having J-rods supported thereon, com-prising:

supporting means operable to be secured to at least two separate drums of said group of drums for supporting the same, a supporting rod member, a pair of receptacle members, each having a recess for receiving the ends of J-rods on said external support for supporting said array of drums, a pivot connection between the ends of said rod member and said supporting means for pivotal movement therebetween, said supporting means including means for angular adjustment of said pivotal connection for tilting said drum array relative to said external support, and said receptacle members being movable toward and away from each other on said rod to vary the position of said drum array.

2. Supporting hardware for an array of drums according to claim 1 in which:

said supporting means comprises a pair of plate members having end portions securable to at least two drums of said array of drums, said plate members being pivotally connected to opposite ends of said rod, said rod being fluted, said receptacle members including clamping surfaces configured to engage the fluted surface of said rod and having a separate abutment surface extending therefrom, clamping bolts securing said receptacle members in a fixed position on said rod and when loosened permitting adjustment of position of said receptacle members along said rod, said angular adjustment means comprising a threaded bolt member on one of said end plates operable on rotation to move against said receptacle member abutment to vary the angular relation of said end plates and establish a selected amount of tilt to the drum array supported on said hardware.

3. Supporting hardware for an array of drums according to claim 2 including:

carriage bolts supported on said receptacle members and engageable with at least one of said drums to provide additional support for said drum array.

* * * * *

UNITED STATES PATENT AND TRADEMARK OFFICE

CERTIFICATE OF CORRECTION

PATENT NO. : 6,172,290 B1
APPLICATION NO. : 09/507800
DATED : January 1, 2009
INVENTOR(S) : May It is certified that error appears in the above-identified patent and that said Letters Patent is hereby corrected as shown below:

Title page, item (62) should read as follows:

Division of application Ser. No. 08/588,244 filed Jan. 18, 1996, now U.S. Pat. No. 5,691,492, issued Nov. 25, 1997, which is a division of Ser. No. 08/976,999 filed Nov. 24, 1997 now U.S. Pat. No. 6,028,257, issued Feb. 22, 2000. This application is also a continuation-in-part of U.S. application Ser. No. 09/497,265 filed Feb. 3, 2000, now U.S. Pat. No. 6,323,407 issued Nov. 27, 2001. And this application is a continuation-in-part of U.S. application No. 09/497,266 filed Feb. 3, 2000, now U.S. Pat. No. 6,329,583 issued Dec. 11, 2001.

Signed and Sealed this

Twenty-first Day of December, 2010

David J. Kappos

David J. Kappos
*Director of the United States Patent and Trademark Office*